US009276323B2

(12) United States Patent
Moon et al.

(10) Patent No.: US 9,276,323 B2
(45) Date of Patent: Mar. 1, 2016

(54) DUAL POLARIZATION ANTENNA FOR A MOBILE COMMUNICATION BASE STATION, AND MULTIBAND ANTENNA SYSTEM USING SAME

(75) Inventors: Young-Chan Moon, Gyeonggi-Do (KR); Sung-Hwan So, Gyeonggi-Do (KR); In-Ho Kim, Gyeonggi-Do (KR)

(73) Assignee: KMW Inc., Hwaseong, Gyeonggi-do (KR)

( * ) Notice: Subject to any disclaimer, the term of this patent is extended or adjusted under 35 U.S.C. 154(b) by 299 days.

(21) Appl. No.: 13/982,952

(22) PCT Filed: Jan. 31, 2012

(86) PCT No.: PCT/KR2012/000712

§ 371 (c)(1),
(2), (4) Date: Jul. 31, 2013

(87) PCT Pub. No.: WO2012/105784

PCT Pub. Date: Aug. 9, 2012

(65) Prior Publication Data

US 2013/0307743 A1 Nov. 21, 2013

(30) Foreign Application Priority Data

Jan. 31, 2011 (KR) ..... 10-2011-0009834

(51) Int. Cl.
*H01Q 21/26* (2006.01)
*H01Q 15/24* (2006.01)
(Continued)

(52) U.S. Cl.
CPC ..... *H01Q 15/24* (2013.01); *H01Q 1/246* (2013.01); *H01Q 5/15* (2015.01); *H01Q 5/40* (2015.01);
(Continued)

(58) Field of Classification Search
USPC ..... 343/833, 797, 798
See application file for complete search history.

(56) References Cited

U.S. PATENT DOCUMENTS 6,025,798 A 2/2000 Colombel et al.
6,034,649 A 3/2000 Wilson et al.
(Continued)

FOREIGN PATENT DOCUMENTS

CA 2242705 A1 1/1999
CN 101271997 A 9/2008
(Continued)

OTHER PUBLICATIONS

Examination Report dated Aug. 5, 2014 issued in connection with Chinese Application No. 201280007148.7, with English translation.
(Continued)

*Primary Examiner* — Tan Ho
(74) *Attorney, Agent, or Firm* — Mintz Levin Cohn Ferris Glovsky and Popeo, P.C.; Kongsik Kim; Colleen H. Witherell

(57) ABSTRACT

The present invention relates to a dual polarization antenna comprising a reflection plate, and a radiating module including first to fourth radiating elements having respective first to fourth radiating arms having respective bent portions. The bent portions of the first to fourth radiation arms are sequentially adjacent to each other, and sequentially form ㄱ, ㄱ, ㄴ, ㄴ and ㄴ shaped structures. The ㄱ, ㄱ, ㄴ and ㄴ shaped structures are located on a third quadrant, a fourth quadrant, a second quadrant, and a first quadrant, respectively. The first to fourth radiating elements have supports integrally extending from the bent portions of the first to fourth radiating arms to the reflection plate. The radiating module includes a first feeder line installed to transmit signals to the first and third radiating arms, and a second feeder line installed to transmit signals to the second and fourth radiating arms.

15 Claims, 11 Drawing Sheets

(51) Int. Cl.

| | |
|---|---|
| ***H01Q 1/24*** | (2006.01) |
| ***H01Q 21/08*** | (2006.01) |
| ***H01Q 21/28*** | (2006.01) |
| ***H01Q 5/15*** | (2015.01) |
| ***H01Q 5/40*** | (2015.01) |
| ***H01Q 5/48*** | (2015.01) |
| ***H01Q 19/10*** | (2006.01) |

(52) U.S. Cl.
CPC ..... *H01Q 5/48* (2015.01); *H01Q 19/108* (2013.01); *H01Q 21/08* (2013.01); *H01Q 21/26* (2013.01); *H01Q 21/28* (2013.01)

(56) References Cited

U.S. PATENT DOCUMENTS

| | | | | |
|---|---|---|---|---|
| 6,195,063 | B1 * | 2/2001 | Gabriel | H01Q 1/523 343/700 MS |
| 6,313,809 | B1 | 11/2001 | Gabriel et al. | |
| 7,804,460 | B2 * | 9/2010 | Lee | H01Q 9/26 343/797 |
| 8,199,063 | B2 | 6/2012 | Moon et al. | |
| 2007/0097007 | A1 | 5/2007 | Milyakh | |
| 2009/0179814 | A1 | 7/2009 | Park et al. | |
| 2009/0278759 | A1 * | 11/2009 | Moon | H01Q 1/246 343/810 |
| 2014/0028516 | A1 * | 1/2014 | Semonov | H01Q 21/26 343/798 |

FOREIGN PATENT DOCUMENTS

| | | | |
|---|---|---|---|
| CN | 101548434 | A | 9/2009 |
| CN | 101714702 | A | 5/2010 |
| CN | 201584504 | U | 9/2010 |
| CN | 101916902 | A | 12/2010 |
| JP | 2006-352293 | A | 12/2006 |
| JP | 3853596 | B2 | 12/2006 |
| JP | 2010-503356 | A | 1/2010 |
| KR | 10-2001-0040623 | A | 5/2001 |
| KR | 10-2005-0069746 | A | 7/2005 |
| KR | 10-2009-0038465 | A | 4/2009 |
| KR | 10-2010-0073946 | A | 7/2010 |
| WO | WO-2008032951 | A1 | 3/2008 |

OTHER PUBLICATIONS

Examination Report dated Aug. 25, 2014 issued in connection with Japanese Application No. 2013-551914.

European Search Report dated Jul. 24, 2015 issued in connection with European Application No. 12742115.4.

Chinese Office Action issued Oct. 21, 2015 in the corresponding Chinese Patent Application No. 201280007148.7.

* cited by examiner

DUAL POLARIZATION ANTENNA FOR A MOBILE COMMUNICATION BASE STATION, AND MULTIBAND ANTENNA SYSTEM USING SAME

CROSS-REFERENCES TO RELATED APPLICATIONS

This application is a U.S. national phase application, pursuant to 35 U.S.C. §371, of PCT/KR2012/000712, filed Jan. 31, 2012, designating the United States, which claims priority to Korean Application No. 10-2011-0009834, filed Jan. 31, 2011. The entire contents of the aforementioned patent applications are incorporated herein by this reference.

TECHNICAL FIELD

The present invention relates to a mobile communication (PCS, cellular, IMT-2000, and the like) base station antenna, and more particularly, to a dual polarization antenna and a multiple band antenna system using the same.

BACKGROUND ART

Currently, various frequency bands are becoming available to sufficiently compensate for deficient frequency bands as mobile communications become common and wireless broadband data communications become activated. The mainly used frequency bands are low frequency bands (698 to 960 MHz) and high frequency bands (1.71 to 2.17 GHz or 2.3 to 2.7 GHz). Further, the multiple antenna based MIMO (Multiple Input Multiple Output) technology is an essential technology for increasing data transmission speed, and is applied to recent mobile communication network systems such as LTE (Long Term Evolution) and Mobile WiMAX.

However, when a plurality of antennas are installed to support the MIMO at various frequency bands, installation costs increase and tower spaces for installing antennas are significantly insufficient in an actual external environment. Further, tower rent costs increase and antenna management efficiency becomes an important problem.

Thus, triple band antennas are urgently requested instead of dual band antennas. While a high frequency band is inserted into an installation space for a low frequency band antenna and thus a width of the low frequency band antenna may be maintained according to a dual band antenna, it is difficult to insert a high frequency band antenna without increasing an antenna width when a triple band antenna is realized.

Meanwhile, due to a fear of common people that electromagnetic waves radiated from an antenna are harmful to human bodies, mobile communication providers conceal antennas if possible and decorate antennas in an environment-friendly way, making sizes of antennas important. Further, since installation of antennas tends to be prohibited unless local residents agree with the installation, recent mobile communication network antennas can be changed and installed only if the widths of the antennas do not exceed a width (for example, about 300 mm) of a conventionally installed low frequency antenna. Of course, classical problems such as a wind pressure load and a load applied to a tower still exist.

Thus, although triple band antennas are urgently requested in recent mobile communication network systems, a conventional wide antenna width cannot be allowed in the market.

SUMMARY

Therefore, the present invention has been made in view of the above-mentioned problems, and an aspect of the present invention is to provide a dual polarization antenna for a mobile communication base station for optimizing a structural arrangement and antenna size of the dual polarization antenna to facilitate a design of the antenna, and a multiple band antenna system using the same.

Another aspect of the present invention is to provide a dual polarization antenna for a mobile communication base station for narrowing a width of the antenna and realizing a triple band antenna in a limited width, and a multiple band antenna system using the same.

In accordance with an aspect of the present invention, there is provided a dual polarization antenna comprising: a reflection plate; and a radiation module comprising first to fourth radiation devices comprising first to fourth radiation arms having bending parts, respectively, wherein the bending parts of the first to fourth radiation arms are sequentially adjacent to each other and are symmetrical to each other in four directions to form a ⌖ shape when viewed from the top, the first to fourth radiation devices have supports integrally extending toward the reflection plate at the bending parts of the first to fourth radiation arms, and the radiation module comprises a first feeding line installed to transfer signals to the first and third radiation arms and a second feeding line installed to transfer signals to the second and fourth radiation arms.

In accordance with another aspect of the present invention, there is provided a multiple band antenna system comprising: a reflection plate; a first radiation module comprising first to fourth radiation devices comprising first to fourth radiation arms having bending parts, respectively, wherein the first to fourth radiation arms are disposed on the reflection plate such that the bending parts are sequentially adjacent to each other and form a ⌖ shape when viewed from the top; and a second or third radiation module installed on the reflection plate at a least one of upper and lower sides of left and right sides of the installation site of the first radiation module having the ⌖ shape.

As described above, a dual polarization antenna for a mobile communication base station and a multiple band antenna system using the same can optimize a structural arrangement and antenna size of the dual polarization antenna to facilitate design of the antenna and narrow a width of the antenna and realize a triple band antenna in a limited width.

DETAILED DESCRIPTION

Hereinafter, exemplary embodiments of the present invention will be described in detail with reference to the accompanying drawings. Meanwhile, a structure of a conventional dual polarization antenna will be described first to help understanding of the present invention.

Figure 1:
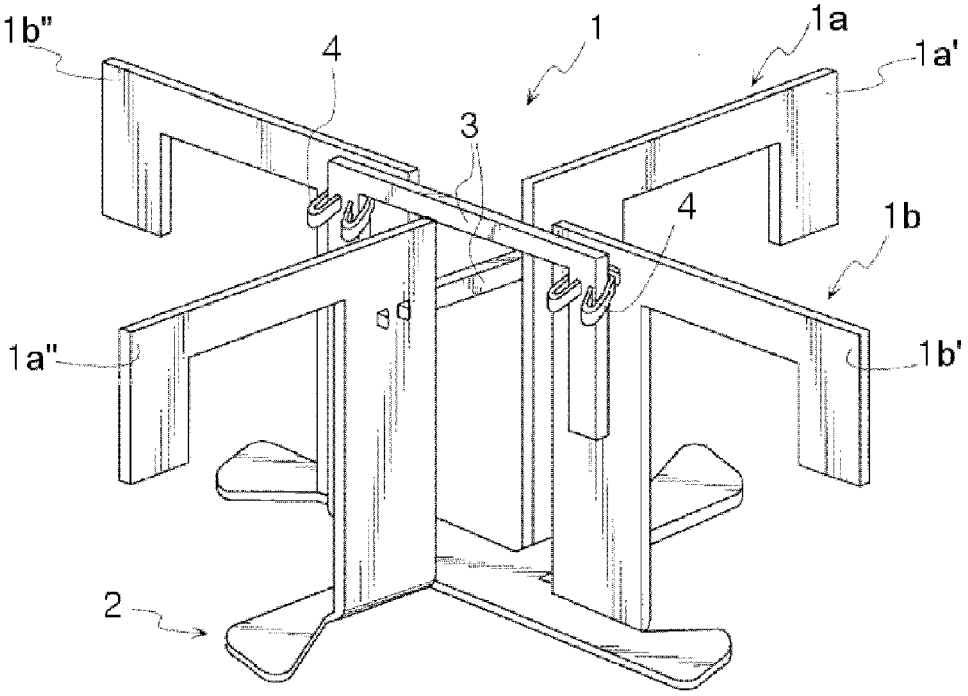
FIG. 1 is a perspective view showing an example of a conventional dual polarization antenna.

FIG. 1 is a perspective view showing an example of a conventional dual polarization antenna, and shows a structure disclosed in U.S. Pat. No. 6,034,649 of 'Andrew Corporation'. Referring to FIG. 1, in the conventional dual polarization antenna, a radiation module 1 has first and second dipoles 1*a* and 1*b* installed to cross each other, and thus is realized in an 'X' form as a whole. The first dipole 1*a* includes two half dipoles 1*a*' and 1*a*", which are installed at +45 degrees with respect to a vertical axis or a horizontal axis, and the second dipole 1*b* also includes two half dipoles 1*b*' and 1*b*", which are installed at −45 degrees. The half dipoles 1*a*', 1*a*", 1*b*', and 1*b*" of the first and second dipoles 1*a* and 1*b* are supported on a reflection plate by a balun and a base 2.

Then, signals are transferred in a non-contact coupling method by a plurality of microstrip hooks 3 generally similar to a hook shape between the two half dipoles 1*a*' and 1*a*" of the first dipole 1*a* and between the two half dipoles 1*b*' and 1*b*" of the second dipole 1*b*. A plurality of clips 4 are installed to support the plurality of microstrip hooks 3 and maintain intervals between the microstrip hooks 3 and the dipoles.

In this way, 'X' shaped dual polarizations are generated by the radiation module 1 realized generally in an 'X' form. Current mobile communication base station antennas mainly support dual polarization diversities and the mainly used conventional dipole antennas are in the 'X' form.

Figure 2:
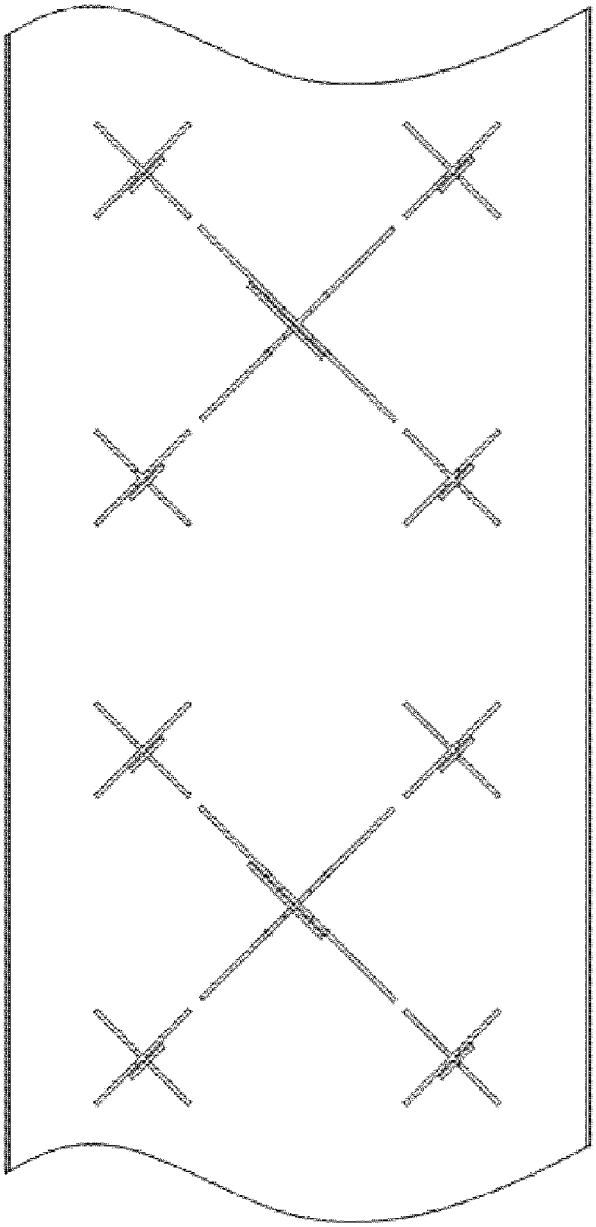
FIG. 2 is a plan view showing a virtual structure for realizing a triple band dual polarization antenna using the antenna of FIG. 1.

However, considering a case of realizing a triple band antenna in a 'X' form antenna structure, as shown in FIG. 2, an outer end of a low frequency band dipole located at the center thereof is adjacent to outer ends of high frequency band dipoles located on left and right side surfaces thereof, and radiation characteristics of the antenna are significantly distorted by the generated interference. The problem may be easily solved by enlarging a width of the antenna so as not to exclude influences of the interference, but the measure has a size problem and cannot be accepted by the market.

The present invention provides a new form of an antenna structure, escaping from the conventional X form dipole structure, which minimizes a width of the antenna particularly when a triple band antenna is applied.

Figure 3:
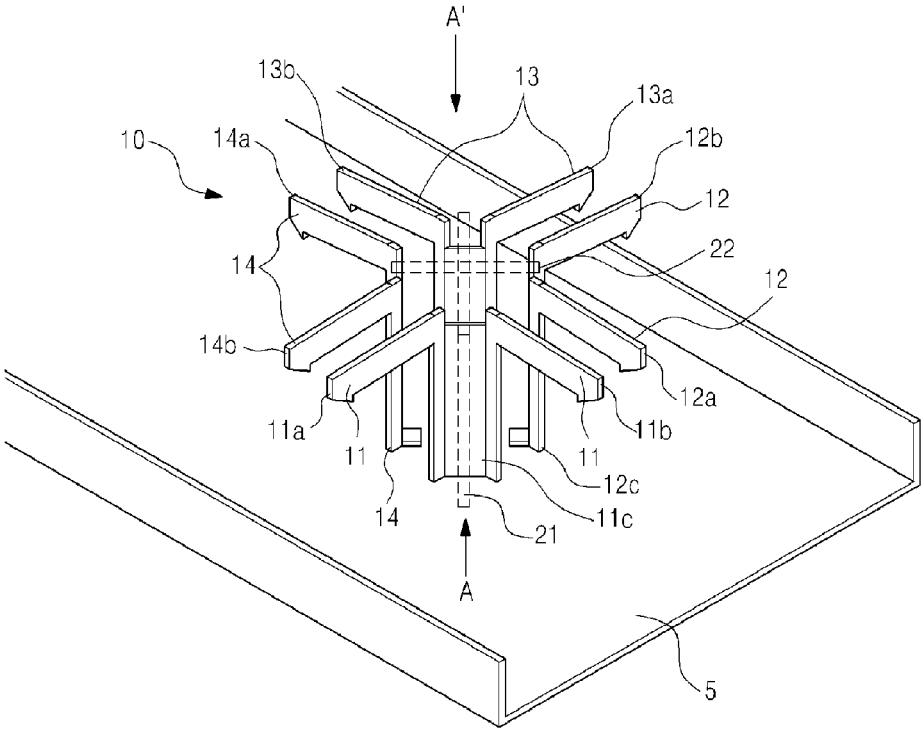
FIG. 3 is a perspective view showing a structure of a dual polarization antenna according to an embodiment of the present invention.
Figure 4:
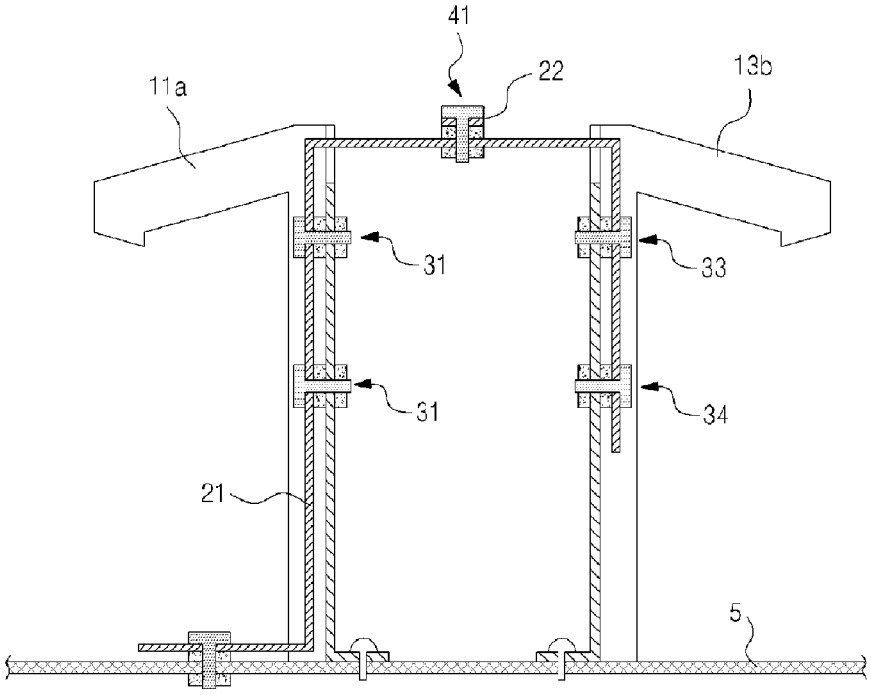
FIG. 4 is a cutaway sectional view taken along line A-A' of FIG. 1.
Figure 5:
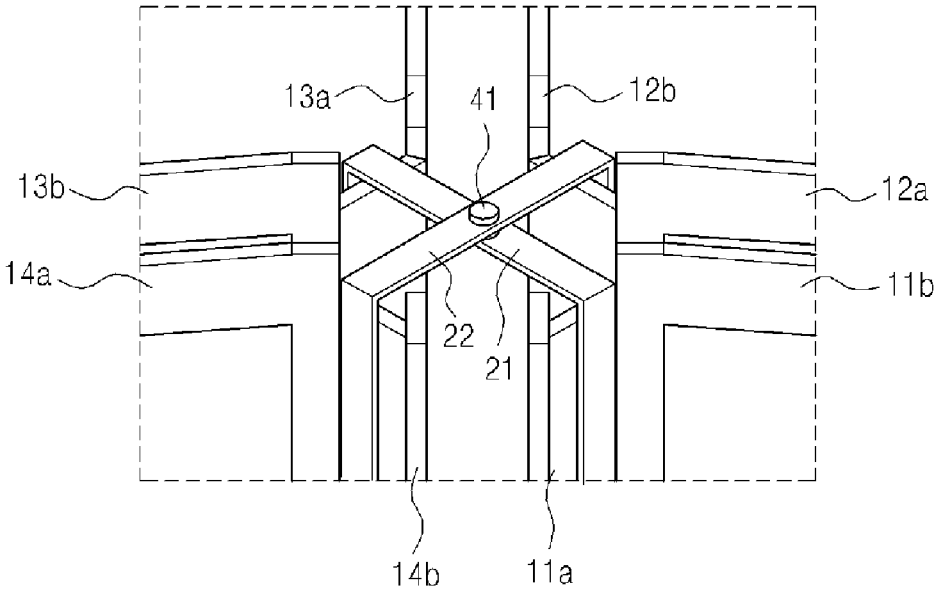
FIG. 5 is an enlarged perspective view of a central upper end of FIG. 1.

FIG. 3 is a perspective view showing a structure of a dual polarization antenna according to an embodiment of the present invention, in which a feeding structure is schematically shown by dotted lines for convenience' sake. FIG. 4 is a cutaway sectional view taken along line A-A' of FIG. 1. FIG. 5 is an enlarged perspective view of a central upper end of FIG. 1, in which a cut form including the feeding structure is shown.

Referring to FIGS. 3 to 5, the dual polarization antenna according to the embodiment of the present invention may be realized by a first radiation module 10 for a first frequency band (for example, a frequency band of about 700 to 1000 MHz). The first radiation module 10 includes bending parts, and for example, includes first to fourth radiation devices including first to fourth radiation arms 11, 12, 13, and 14 having a 'ㄱ' shape, respectively. Then, the bending parts of the first to fourth radiation arms 11, 12, 13, and 14 are sequentially adjacent to each other and are symmetrical to each other in four directions to form a '卐' shape when viewed from the top.

That is, although disposition directions and locations of the first to fourth radiation arms 11, 12, 13, and 14 are different, the first to fourth radiation arms 11, 12, 13, and 14 may have the same structure. For example, a bending angle of the bending part of the first radiation device 11 may be, for example, a right angle, and includes first and second conductive radiation arms 11*a* and 11*b* in which ends of the '⌉' shape form, for example, 90 degrees and which is designed to have a predetermined length. Then, a support 11*c* integrally extending toward an antenna reflection plate 5 is formed at a connecting part of the first and second radiation arms 11*a* and 11*b*, that is, the bending part of the first radiation arm 11. Then, the support 11*c* may be fixedly attached to the reflection plate 5 through screw coupling or welding. Likewise, the second to fourth radiation arms 12, 13, and 14 includes first radiation arms 12*a*, 13*a*, and 14*a*, second radiation arms 12*b*, 13*b*, and 14*b*, and supports 12*c*, 13*c*, and 14*c*. For example, the first to fourth radiation arms 11, 12, 13, and 14 sequentially form '⌋' and '⌊' shapes in the '卐' shape. That is, the 'ㄱ', 'ㄱ', 'ㄱ', and 'ㄱ', 'ㄱ', 'ㄱ' parts are located in a third quarter plane, a fourth quarter plane, a second quarter plane, and a first quarter plane, respectively.

The first to fourth radiation devices are similar to dipole structures in their external appearances at a glance, but it can be seen that they actually employ a bow-tie structure. That is, as will be described below, the supports 11*c*, 12*c*, 13*c*, and 14*c* form parts of the feeding structure and the first radiation arms 11*a*, 12*a*, 13*a*, and 14*a* and the second radiation arms 11*b*, 12*b*, 13*b*, and 14*b* form suitable radiation surfaces according to a corresponding frequency on opposite sides of the supports 11*c*, 12*c*, 13*c*, and 14*c*. Then, as shown, the first radiation arms 11*a*, 12*a*, 13*a*, and 14*a* and the second radiation arms 11*b*, 12*b*, 13*b*, and 14*b* are configured such that a width of a surface (a lateral surface in the drawing) of a radiation device facing another radiation device is larger than a surface (an upper surface of the drawing) of the radiation device from which signals are radiated. This configuration is done to minimize an influence to another radiation module and achieve a smooth radiation through impedance matching (adjustment) with an adjacent radiation arm.

Meanwhile, in a description of a feeding structure of the first radiation module 10, the first feeding line 21 having a strip line structure is installed to transmit a signal through non-contact coupling with the supports 11*c* and 13*c* of the first and third radiation arms 11 and 13, and the second feeding line 22 is installed to transmit a signal through non-contact coupling with the supports 12*c* and 14*c* of the second and fourth radiation arms 12 and 14.

Then, parallel surfaces for maintaining a preset space distance while facing striplines of the first and second feeding lines 21 and 22 are formed at central longitudinal axes of the supports 11*c*, 12*c*, 13*c*, and 14*c* so that signals are transferred therebetween through a non-contact coupling method. Spacers 31, 32, 33, and 34 having suitable structures for supporting the feeding lines 21 and 22 and maintaining the spacing between the feeding lines and the supports to be constant may be installed at preset locations between parallel surfaces of the supports 11*c*, 12*c*, 13*c*, and 14*c* and the strip lines of the first and second feeding lines 21 and 22 to maintain the spacing distance. The spacers 31, 32, 33, and 34 may include, for example, a female screw structure located between the paral surfaces of the supports 11*c*, 12*c*, 13*c*, and 14*c* and the strip lines of the first and second feeding lines 21, and a male screw structure coupled to the female screw structure through holes formed at locations of the first and second feeding lines 21 and 22 and/or the supports 11*c*, 12*c*, 13*c*, and 14*c*.

In a more detailed description of the installation structures of the first and second feeding lines 21 and 22, the first feeding line 21 extends from a lower side of the support 11*c* of the first radiation arm 11 toward an upper side thereof while partially extending along the reflection plate 5 in a strip line structure, exceeds the bending part of the first radiation arm 11 to extend to the third radiation arm 13 of the third radiation device so as to face a slant line direction, and exceeds the bending part of the third radiation arm 13 to further extend to the support 13*c* of the third radiation arm 13. Likewise, the second feeding line 22 is formed along the supports 12*c* and 14*c* of the second radiation arm 12 and the fourth radiation arm 14. According to the structure, the first and second feeding lines 21 and 22 cross each other (to be spaced apart from each other) at a middle part of the first radiation module 10, and a spacer 41 having a suitable structure may be provided at the crossed part to prevent a contact between the two feeding lines and prevent a mutual influence of transmitted signals.

Meanwhile, outer sides of the parallel surfaces of the first and second feeding lines 21 and 22 from central longitudinal axes of the supports 11*c*, 12*c*, 13*c*, and 14*c*, that is, side surfaces of the supports 11*c*, 12*c*, 13*c*, and 14*c* further extend to surround the strip lines of the first and second feeding lines 21 and 22. Since the supports act as the ground terminals, the structure can show a more improved grounding performance. That is, since the extension structure is inclined toward the strip lines to surround the supports, loss of signals can be reduced.

Further, since the supports 11*c*, 12*c*, 13*c*, and 14*c* electrically serve as ground terminals to the strip lines, a length of the supports is designed according to $\lambda/4$ to achieve an open state (ground state).

Figure 9:
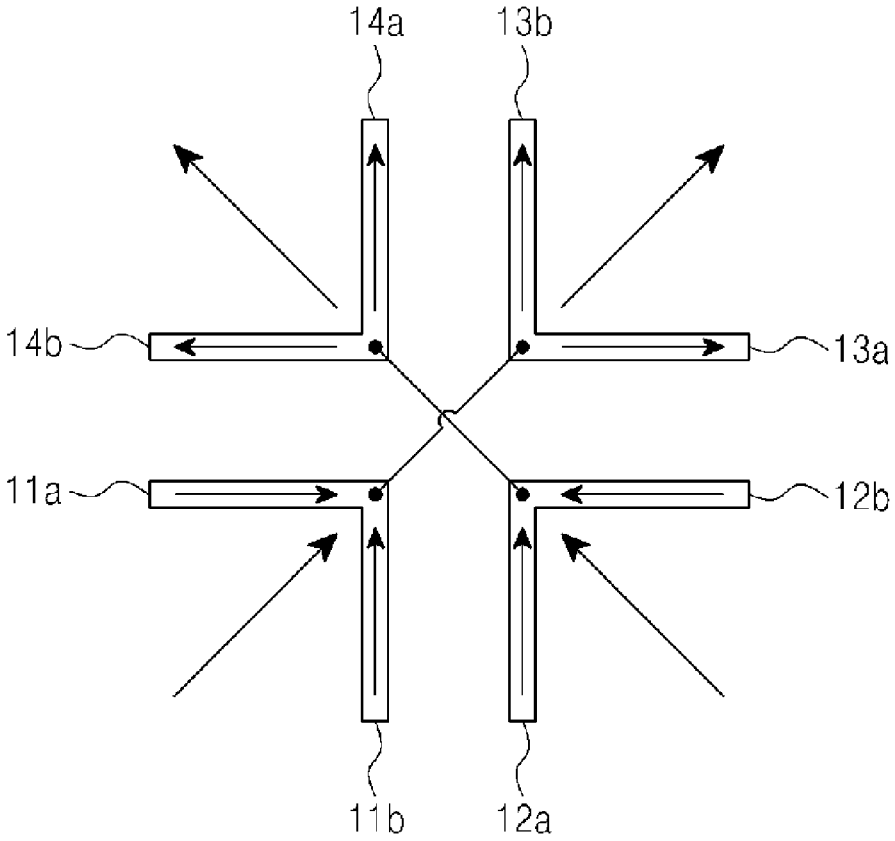
FIG. 9 is a view showing a dual polarization forming state in a dual polarization antenna according to another embodiment of the present invention.

Due to the feeding structure, as shown in FIG. 9, the first radiation arm 11 and the third radiation arm 13 form +45 degree polarizations of the 'X' polarizations with respect to a vertical axis and the second and fourth radiation arms 12 and 14 form −45 degree polarizations.

Figure 6A:
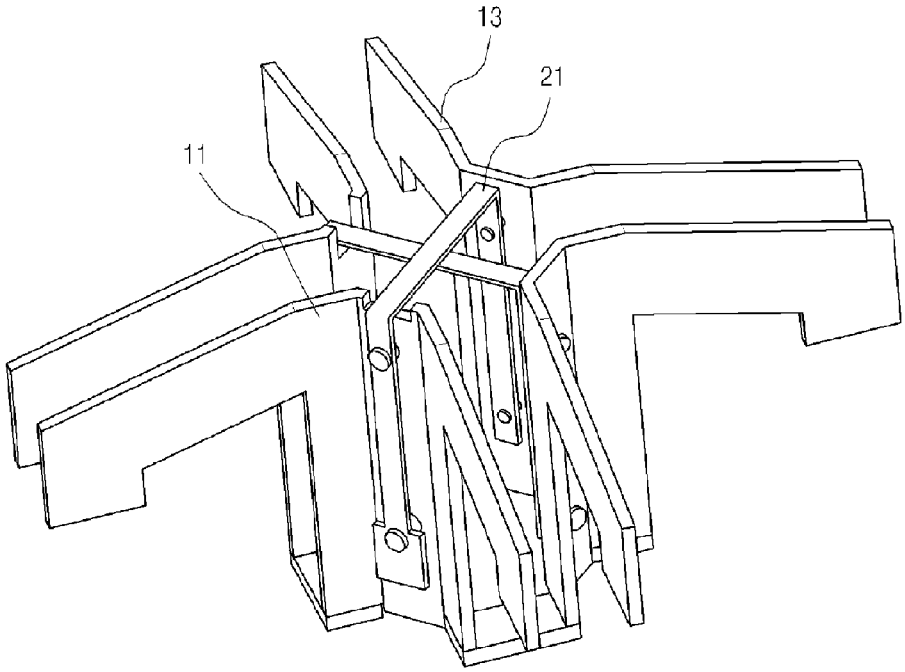
FIG. 6A is a perspective view of a first modification structure of FIG. 1.
Figure 6B:
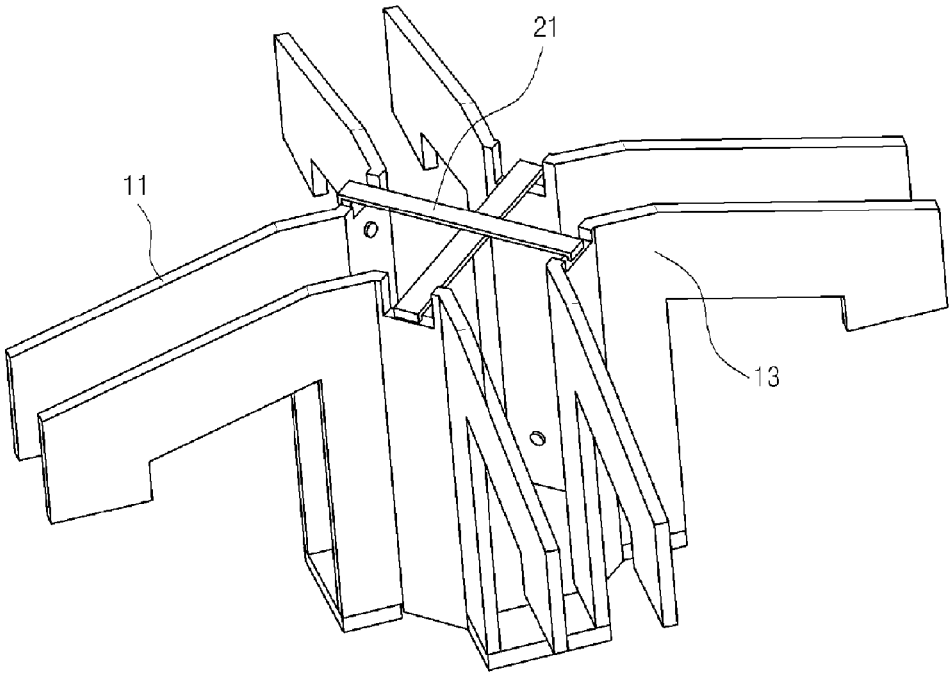
FIG. 6B is a perspective view of a second modification structure of FIG. 1.

FIG. 6A is a perspective view of a first modification structure of FIG. 1. FIG. 6B is a perspective view of a second modification structure of FIG. 1. The structures shown in FIGS. 6A and 6B are characterized, in particular, in the feeding structures as compared with the structure shown in FIG. 1. In the structure shown in FIG. 6A, for example, the first feeding line 21 exceeds the bending part of the first radiation arm 11 to extend to the third radiation arm 13 facing in a slant line direction but does not exceed the bending part of the third radiation arm 13 to extend inward.

In the structure shown in FIG. 6B, for example, the first feeding line 21 exceeds the bending part of the first radiation arm 11 to extend to the third radiation arm 13 facing in a slant line direction, and is directly connected to the bending part of the third radiation arm 13 through welding or soldering.

Meanwhile, it can be seen that the feeding structure of the present invention employs a so called over bridge method unlike a side bridge method in which the feeding lines are installed between side surfaces of radiation devices in a dipole structure as shown in FIG. 1.

Further, since the supports include air strip balun structures serving as ground terminals of the feeding lines having a strip line structure in the feeding structure of the present invention, the feeding structure of the present invention can be realized more simply and efficiently as compared with a method of employing balum structures in the conventional radiation structures having the conventional dipole structure.

Figure 7:
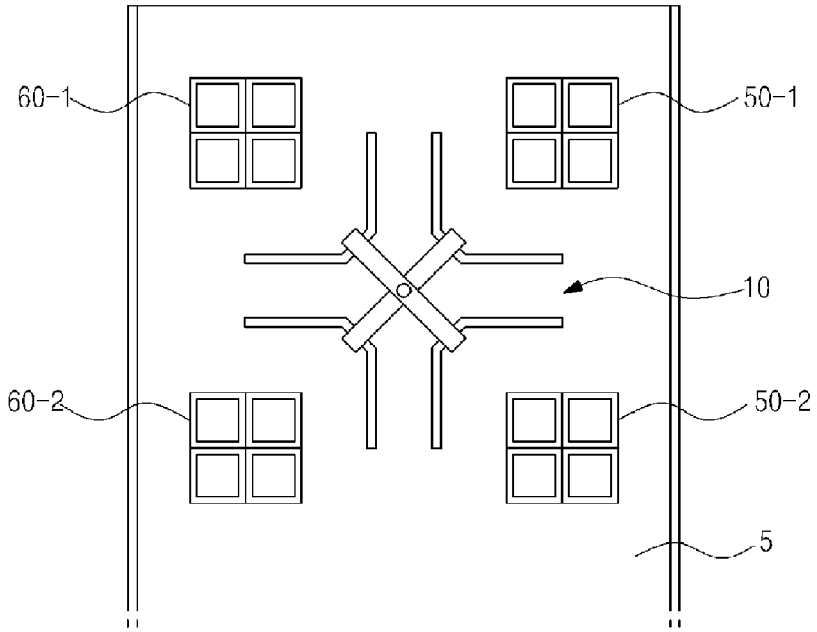
FIG. 7 is a schematic plan view showing a multiple band antenna system using the dual polarization antenna according to the embodiment of the present invention.

FIG. 7 is a schematic plan view showing a multiple band antenna system using the dual polarization antenna according to the embodiment of the present invention. Referring to FIG. 7, the multiple band multiple antenna system according to the embodiment of the present invention includes, for example, a first radiation module 10 for a first frequency band (for example, a frequency band of about 700 to 1000 MHz), second radiation modules 50-1 and 50-2 for a second frequency band (for example, a frequency band of 1.7 to 2.2 GHz), and third radiation modules 60-1 and 60-2 for a third frequency band (for example, a frequency band of 2.3 to 2.7 GHz).

The first radiation module 10 may have a dual polarization antenna structure according to the embodiment of the present invention shown in FIGS. 2 to 4.

Although the second radiation modules 50-1 and 50-2 and the third radiation modules 60-1 and 60-2 may have the antenna structure according to the embodiment of the present invention shown in FIGS. 2 to 4, they may employ antenna structures of various conventional dipole structures and various forms such as a tetrahedral form, an 'X' form, and a lozenge form may be applied to the entire outer forms.

Then, the second radiation modules 50-1 and 50-2 and the third radiation modules 60-1 and 60-2 are installed at upper and lower sides of left and right sides of the installation site of the first radiation module 10 having a ⋔ shape as a whole. That is, assuming that the disposition structure of the antenna system forms a tetrahedral shape, the second radiation modules 50-1 and 50-2 and the third radiation modules 60-1 and 60-2 are installed at corners of the tetrahedral shape, respectively and the first radiation module 10 is installed at a center of the tetrahedral shape.

Then, the first radiation module 10 having a ⋔ shape has empty spaces at upper and lower portions of the left and right sides of the installation site, and the second and third radiation modules 50-1, 50-2, 60-1, and 60-2 are installed such that the installation sites of the second radiation modules 50-1 and 50-2 and the third radiation modules 60-1 and 60-2 at least partially overlap the empty spaces of the installation site of the first radiation module 10.

Due to the installation structure, an entire size of the antenna system can be reduced and can be optimized when an antenna system of multiple bands, in particular, triple bands is realized.

Moreover, strong electric fields are generated at outer ends of the radiation structures in the radiation devices to generate interference of signals with adjacent radiation devices, and in the structure of the antenna system according to the present invention, a sufficient distance can be secured between the second and third radiation modules adjacent to an outer end of the radiation device of the first radiation module 10 with a reduced side.

Figure 8A:
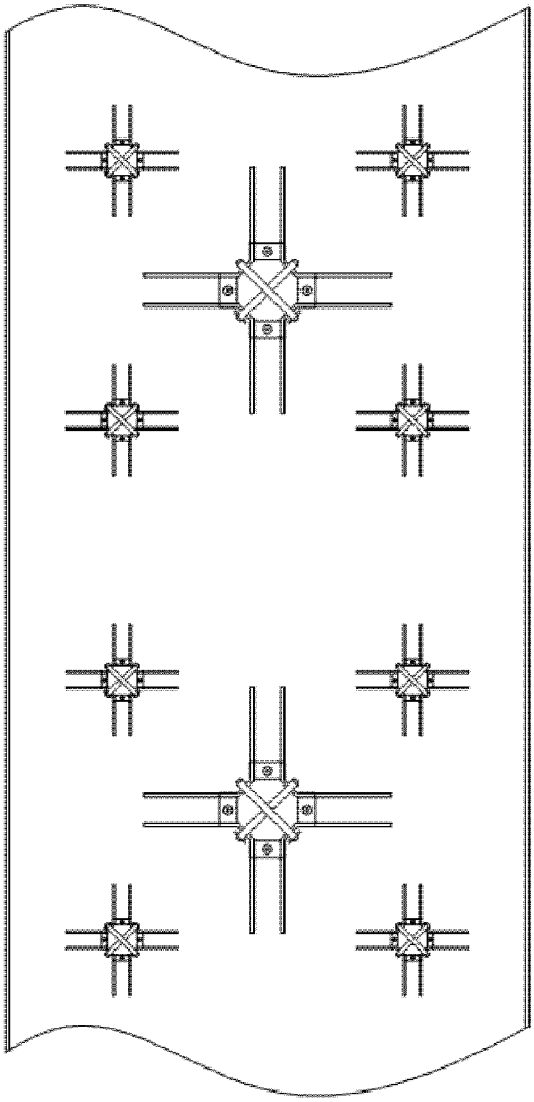
FIG. 8A is a plan view showing a modification structure of FIG. 7.
Figure 8B:
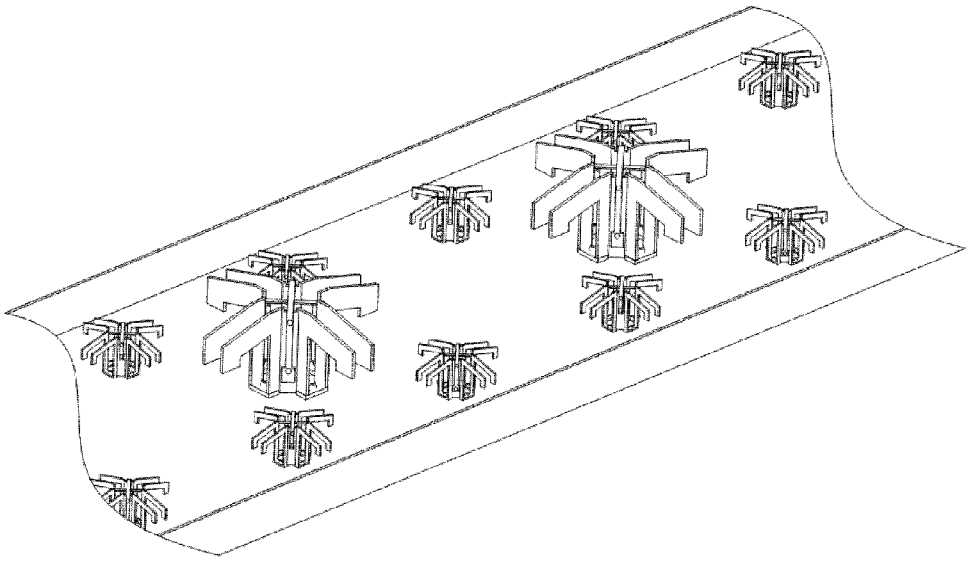
FIG. 8B is a perspective view of FIG. 8B.

Meanwhile, FIGS. 8A and 8B show a plan view and a perspective view of the modified structure of FIG. 7, and as shown in FIGS. 8A and 8B, all of the first to third radiation modules 10 may have the dual polarization antenna structure according to the embodiment of the present invention shown in FIGS. 2 to 4.

The dual polarization antenna for a mobile communication base station according to the embodiment of the present invention and the multiple band antenna system using the same can be configured as described above. Meanwhile, although the detailed embodiments have been described in the description of the present invention, various modifications can be made without departing from the scope of the present invention.

The invention claimed is:

1. A dual polarization antenna comprising:

a reflection plate; and a radiation module comprising first to fourth radiation devices comprising first to fourth radiation arms having bending parts, respectively, wherein the bending parts of the first to fourth radiation arms are sequentially adjacent to each other and are symmetrical to each other in four directions to form a '卐' shape when viewed from the top, the first to fourth radiation devices have supports integrally extending toward the reflection plate at the bending parts of the first to fourth radiation arms, and the radiation module comprises a first feeding line installed to transfer signals to the first and third radiation arms and a second feeding line installed to transfer signals to the second and fourth radiation arms, and wherein the first and second feeding lines are strip lines, the first feeding line transfers a signal through non-contact coupling with the first radiation arm, and the second feeding line transfers a signal through non-contact coupling with the second radiation arm.

2. The dual polarization antenna of claim 1, wherein the first feeding line extends to the support of the third radiation device facing in a slant line direction via the bending part of the first radiation arm along the support of the first radiation device, and the second feeding line extends to the support of the fourth radiation device facing in a slant line direction along the bending part of the second radiation arm along the support of the second radiation device.

3. The dual polarization antenna of claim 2, wherein a plurality of spacers for supporting the feeding lines and maintaining intervals of the supports to be constant are formed between the first and second feeding lines and the supports of the first to fourth radiation devices, and a spacer for preventing a contact between the two feeding lines is further formed at a site where the first and second feeding lines cross each other.

4. The dual polarization antenna of claim 1, wherein the first feeding line is connected to the third radiation arm of the third radiation device facing in a slant line direction via the bending part of the first radiation arm along the support of the first radiation device, and the second feeding line is connected to the fourth radiation arm of the fourth radiation device facing in a slant line direction via the bending part of the second radiation arm along the support of the second radiation device.

5. The dual polarization antenna of claim 1, wherein the first to fourth radiation arms of the first to fourth radiation devices are configured such that a width of a surface of a radiation device facing another radiation device is larger than a surface of the radiation device from which signals are radiated.

6. The dual polarization antenna of claim 1, wherein a bending angle of the bending parts of the first to fourth radiation arms is a right angle.

7. The dual polarization antenna of claim 1, wherein lengths of the supports of the first to fourth radiation devices are designed based on a wavelength of a processed signal to be opened.

8. A multiple band antenna system comprising:

a reflection plate;

a first radiation module comprising first to fourth radiation devices comprising first to fourth radiation arms having bending parts, respectively, wherein the first to fourth radiation arms are disposed on the reflection plate such that the bending parts sequentially adjacent to each other and form a '卐' shape when viewed from the top; and a second or third radiation module installed on the reflection plate at at least one of upper and lower sides of left and right sides of the installation site of the first radiation module having the '卐' shape, wherein the first to fourth radiation devices comprise supports integrally extending from the bending part of the first to fourth radiation arms toward the reflection plate, and the first radiation module comprises a first feeding line installed to transmit signals to the first and third radiation arms and a second feeding line installed to transmit signals to the second and fourth radiation arms, and, wherein the first and second feeding lines are strip lines, and the first feeding line transfers a signal through non-contact coupling with the first radiation arm, and the second feeding line transfers a signal through non-contact coupling with the second radiation arm.

9. The multiple band antenna system of claim 8, wherein the second or third radiation module is installed such that the installation site of the second or third radiation module at least partially overlap empty spaces at upper and lower portions of left and right sides of the first radiation module having the '卐' shape.

10. The multiple band antenna of claim 8, wherein the first feeding line extends to the support of the third radiation device facing in a slant line direction via the bending part of the first radiation arm along the support of the first radiation device, and the second feeding line extends to the support of the fourth radiation device facing in a slant line direction along the bending part of the second radiation arm along the support of the second radiation device.

11. The multiple band antenna of claim 10, wherein a plurality of spacers for supporting the feeding lines and maintaining intervals of the supports to be constant are formed between the first and second feeding lines and the supports of the first to fourth radiation devices, and a spacer for preventing a contact between the two feeding lines is further formed at a site where the first and second feeding lines cross each other.

12. The multiple band antenna of claim 8, wherein the first feeding line is connected to the third radiation arm of the third radiation device facing in a slant line direction via the bending part of the first radiation arm along the support of the first radiation device, and the second feeding line is connected to the fourth radiation arm of the fourth radiation device facing in a slant line direction via the bending part of the second radiation arm along the support of the second radiation device.

13. The multiple band antenna of claim 8, wherein the first to fourth radiation arms of the first to fourth radiation devices are configured such that a width of a surface of a radiation device facing another radiation device is larger than a surface of the radiation device from which signals are radiated.

14. The multiple band antenna of claim 8, wherein a bending angle of the bending parts of the first to fourth radiation arms is a right angle.

15. The multiple band antenna of claim 8, wherein lengths of the supports of the first to fourth radiation devices are designed based on a wavelength of a processed signal to be opened.

* * * * *